United States Patent [19]

Theurer

[11] 4,248,154

[45] Feb. 3, 1981

[54] MOBILE TRACK TAMPING MACHINE WITH LIFTING AND LINING EQUIPMENT

[75] Inventor: Josef Theurer, Vienna, Austria

[73] Assignee: Franz Plasser Bahnbaumaschinen-Industriegesellschaft m.b.H., Vienna, Austria

[21] Appl. No.: 13,382

[22] Filed: Feb. 21, 1979

[30] Foreign Application Priority Data

May 11, 1978 [AT] Austria ..... 3446/78

[51] Int. Cl.[3] ..... E01B 27/17; E01B 29/04

[52] U.S. Cl. ..... 104/7 B; 104/12

[58] Field of Search ..... 104/2, 7 R, 7 B, 8, 104/12

[56] References Cited

U.S. PATENT DOCUMENTS

| | | | |
|---|---|---|---|
| 3,250,229 | 5/1966 | Keller | 104/7 R |
| 3,392,678 | 7/1968 | Plasser et al. | 104/12 |
| 3,690,263 | 9/1972 | Plasser et al. | 104/8 |
| 3,732,827 | 5/1973 | Anderson | 104/7 R |
| 3,832,952 | 9/1974 | Hurni | 104/7 B |
| 3,968,752 | 7/1976 | Theurer | 104/7 B |
| 4,111,128 | 9/1978 | Keyes | 104/7 B |

FOREIGN PATENT DOCUMENTS

| | | | |
|---|---|---|---|
| 246212 | 4/1966 | Austria | 104/7 R |
| 1540199 | 2/1979 | United Kingdom | 104/7 R |

*Primary Examiner*—Randolph A. Reese
*Attorney, Agent, or Firm*—Kurt Kelman

[57] ABSTRACT

A mobile track tamping machine carries equipment for lifting and lining track in switches and crossings. This equipment comprises a power-driven support frame for lifting and lining, the support frame running on each track rail with a pair of flanged wheels whose flanges are arranged for engagement with the insides of the rail heads so that the wheels may serve as lining rollers upon lateral movement of the support frame. A lifting tool is mounted on the support frame intermediate each pair of flanged wheels and each lifting tool associated with a respective rail has a hook capable of selectively gripping the rail head and rail base at the outside of the associated track rail upon adjustment of the lifting tool relative to the support frame. A pivot mounts each lifting tool on the support frame, pivots extending in a direction parallel to the machine and enabling the lifting hooks to be pivoted in an operating movement in a plane extending transversely and perpendicularly relative to the track. The lifting tools have hooks arranged to move practically rectilinearly during the operating movement of the tools and they have an additional motion relative to the flanged wheels for selectively gripping the rail head and rail base of the associated track rail and any rail closely adjacent to the outside of one of the track rails in a switch or crossing.

12 Claims, 4 Drawing Figures

MOBILE TRACK TAMPING MACHINE WITH LIFTING AND LINING EQUIPMENT

The present invention relates to a mobile track tamping machine mounted for mobility on a track and including equipment on the machine capable of lifting and laterally moving the track in sections of the track where an additional rail extends closely adjacent the outside of one of the track rails. Such track sections include switches, track crossings, movable switch rails and guide rails encountered along railroad tracks.

Railroad tracks consist of ties resting on ballast to be tamped by the machine and two rails fastened to the ties, each one of the rails having a rail head with an oblique underside and a rail base, the rails defining respective insides facing each other and outsides facing away from each other. In the indicated track sections, an additional rail extends closely adjacent the outside of one of the track rails, leaving only a relatively narrow space between the outside of the track rail and the adjacent rail.

Because of this narrow space and the general configuration of such track sections, difficulties have been encountered in the use of track correcting tools engaging the rails in these sections for correction of the track position while or after the ballast has been tamped, ready and effective rail engagement being obstructed by the presence of such track apparatus as branch rails, guide rails, frogs and the like.

U.S. Pat. No. 3,392,678, dated July 16, 1968, discloses a mobile track tamper equipped with rail lifting hooks which are so adjustable that they may grip a single rail or two closely adjacent rails at a switch. No lining tools are provided.

A mobile track tamper with track lining capability is disclosed in U.S. Pat. No. 3,690,263, dated Sept. 12, 1973. The lining equipment comprises vertically adjustable tools which cooperate with flanged wheels to grip the rails therebetween for laterally moving the track. The tools may be adjusted between a rest and operating position, independently of the flanged wheels, which enables the equipment to be used in track switches and the like. In one illustrated embodiment, the equipment comprises a vertically and laterally movable support frame running on pairs of flanged wheels on the track rails and a rail-engaging hook is mounted intermediate the flanged wheels for gripping each hook. Thus, when the support frame is moved, the flanged wheels serve as lining tools and the hooks serve as lifting tools. The use of two spaced lining tools is highly advantageous since it avoids subjecting the engaged rails to single-point lateral thrusts which may cause bending of the rails.

Another mobile track working machine with lifting and lining capability in track switches, crossings and the like has been disclosed in U.S. Pat. No. 3,832,952, dated Sept. 3, 1974. This machine has equipment for lifting and laterally moving the track, which comprises a support frame mounted on the machine for vertical and lateral movement relative thereto and to the track, power drive means for vertically and laterally moving the support frame to effect lifting and laterally moving the track, a flanged wheel running on each rail and supporting the support frame thereon for movement of the support frame along the track, each wheel having a flange arranged for engagement with the respective insides of the rails whereby the flanged wheels are adapted to serve as lining rollers upon lateral movement of the support frame, and a power-driven lifting hook mounted on the support frame and facing a respective flanged wheel for vertical adjustment, each lifting hook being associated with one track rail and having a hook end capable of selectively gripping the rail head and the rail base at the outside of the associated track rail upon vertical adjustment of the lifting hook. The lining rollers and lifting hooks are mounted on carriers displaceable respectively in laterally and vertically extending guides. The carriers, the associated hydraulic drives for displacing them and the guides wherein they are displaced add to the complexity of the structure and require additional maintenance, and the many guides and movable parts cause rapid wear of the equipment. Particularly since it is subject to heavy loads when used for lifting track switches and the like, the operating life of the equipment is relatively short and interrupted by many breakdowns. In addition, the single flanged wheel cooperating with the facing lifting hook wherebetween the associated rail is gripped subjects the rail to excessive stresses at a single point, causing possible bending under heavy loads. To enable the tools to grip the rails properly, the flanged lining wheels must be additionally moved laterally into engagement with a respective rail by further power drives, thus further complicating the structure, increasing the maintenance problems and obstructing visibility in the area of track correction.

U.S. Pat. No. 3,968,752, dated July 13, 1976, discloses an improvement over the above-described equipment in that the support frame carries pairs of flanged lining wheels associated with each rail, with a vertically movable lifting hook mounted between the flanged wheels of each pair. The flanged wheels are pressed apart so that their flanges flushly engage the insides of the associated rails. This machine is more robust and has been used widely for track work in plain track as well as switches and the like, modified in some instances to have the four flanged wheels mounted rigidly at the four corners of a rectangular support frame and set to gauge to engage the insides of the rails without being pressed apart.

It is the primary object of this invention to provide a mobile track tamping machine with the type of equipment disclosed in the afore-mentioned patent and which is especially robust in construction so as to be able to grip and support with safety all track apparatus at switch points where the track weighs almost twice as much as in ordinary track sections.

This and other objects are accomplished according to the invention in such a track tamping machine with a lifting tool mounted on the support frame intermediate the flanged wheels of each pair of flanged wheels in the direction of the rails, each lifting tool being associated with one track rail and having a hook capable of selectively gripping the rail head and rail base at the outside of the associated track rail and having an additional motion relative to the flanged wheels for selectively gripping the rail head and rail base of the associated track rail and the rail adjacent to the outside of one track rail. Additional power drive means imparts to the hooks the additional motion for selectively gripping the rail head and rail base and the adjacent rail, and a pivot mounts each lifting tool on the support frame. The pivots extends in a direction substantially parallel to the longitudinal extension of the machine and enables the lifting tool to be pivoted in an operating movement in a plane extending perpendicularly and transversely to the track, the hooks being arranged to move practically rectilinearly during the operating movement of the tools.

This mounting of the lifting hook enables the track apparatus in switches to be gripped securely with a minimum of movements and, at the same time, the equipment may be so sturdily constructed that it will securely absorb the substantially increased stresses to which the heavy track apparatus and powerful lining thrusts subject it at switch points, crossings and the like. The pivotal mounting of the lifting hook returns in a modified form to earlier developments, such as represented by U.S. Pat. No. 3,392,678, since only a solid pivotal bearing for the lifting hooks enables the equipment to be of sufficiently sturdy construction. In addition, the equipment of the invention provides much more space and eliminates laterally projecting horizontal guides for the lifting hooks. This, in turn, enhances the visibility since the support frame may be much lower and requires no guides for the displacement of the lifting hook.

The above and other objects, advantages and features of the present invention will become more apparent from the following detailed description of certain now preferred embodiments thereof, taken in conjunction with the accompanying schematic drawing wherein FIG. 1 is a side elevational view of a mobile track tamping machine with equipment according to this invention;

Figures 1, 2, 3, 4:
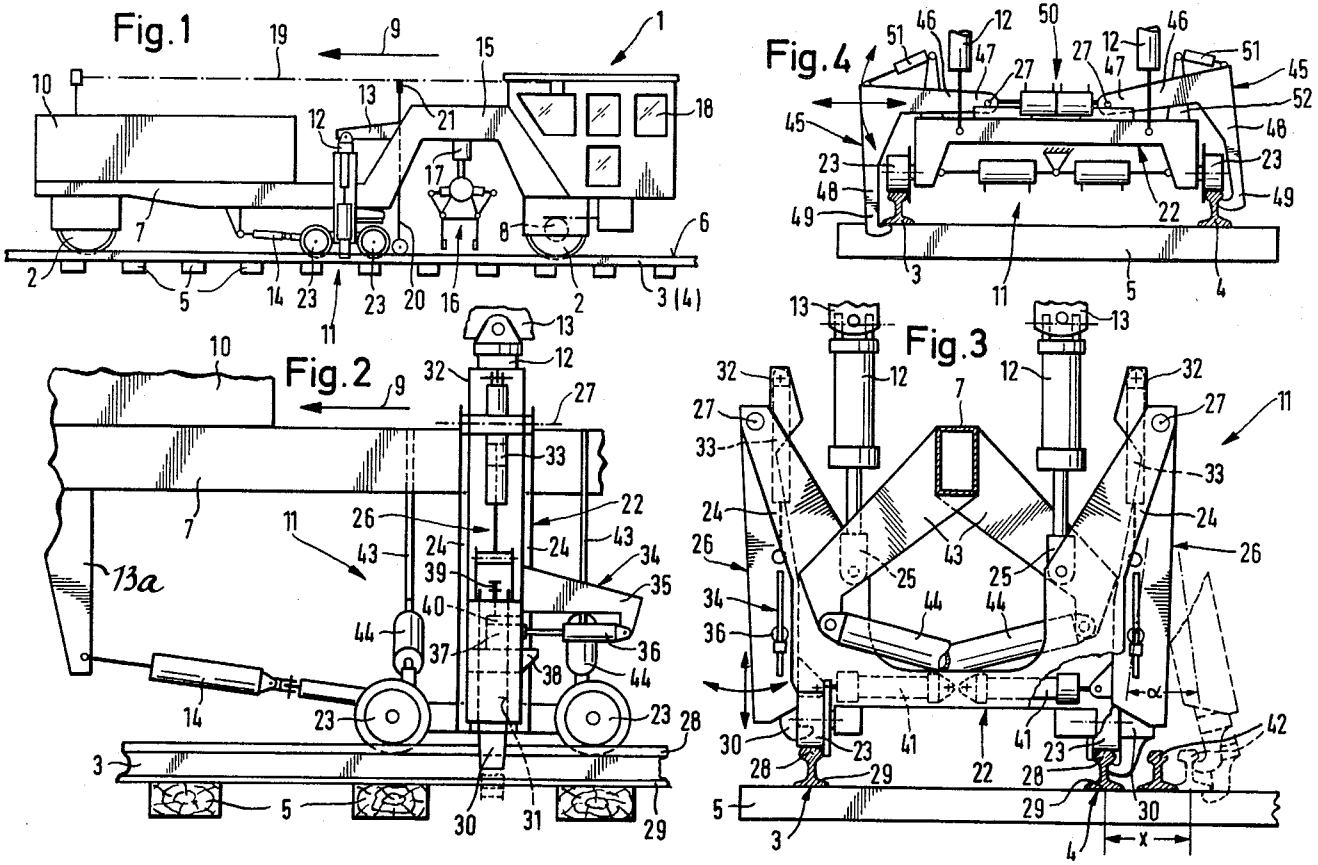
FIG. 2 is an enlarged side elevational view of the equipment of FIG. 1 for lifting and laterally moving track.
FIG. 3 is a front elevational view of the equipment of FIG. 2, seen in the operating direction of the machine.
FIG. 4 is a like, highly diagrammatic view of another embodiment of the equipment.

Referring now to the drawing and first to FIGS. 1 to 3, track tamping machine 1 is mounted for mobility on track 6 consisting of ties 5 resting on ballast to be tamped and two rails 3, 4 fastened to the ties, the machine having frame 7 supported on undercarriages 2 whose wheels run on the track rails. The machine is self-propelled, drive 8 acting on the wheels of rear undercarriage 2 to move the machine in an operating direction indicated by arrow 9. The front part of machine frame 7 carries housing 10 for the power plant of the machine.

Each rail has a rail head 28 and a rail base 29, the rails defining respective insides facing each other and outsides facing away from each other.

Equipment 11 capable of lifting and laterally moving track 6 in sections of the track where an additional rail 42 extends closely adjacent the outside of one of the track rails is mounted on machine frame 7 in front of an upwardly extending portion 15 of the frame which supports tamping units 16 associated with each track rail, the tamping units being vertically adjustably mounted on frame portion 15 and being vertically movable by power drives 17. The illustrated combination makes track tamping machine 1 useful as a production tamper and a switch tamper. Operator's cab 18 with the usual controls for operating the machine is mounted at the rear of the machine frame.

In the illustrated embodiment, the tamper also has a schematically indicated, conventional reference system 19 so that the machine may be used for leveling and lining, equipment 11 for lifting and laterally moving the track being operated under the control of the reference system in a well known manner to produce a desired level and lateral alignment of the track. In the indicated reference system, the ends of a reference line are supported on the machine in vertical alignment with the undercarriages and a respective sensor 20 is supported on each rail 3, 4 by means of a roller, its upper end 21 cooperating in a conventional manner with the reference line to produce a reference signal controlling the leveling operation. Another conventional reference system (not shown) controls the lining operation, the tamping, leveling and lining operations being entirely conventional and forming no part of the present invention, except as far as they are involved with the novel equipment.

One embodiment of this equipment is illustrated in FIGS. 2 and 3. It comprises support frame 22 mounted on machine frame 7 for vertical and lateral movement relative thereto and to the track. Power drive means 12 and 44 are arranged for vertically and laterally moving the support frame to effect lifting and laterally moving the track for leveling and lining. In addition, power drive means 14 is arranged to move support frame 22 longitudinally in the direction of the track for repositioning the support frame therealong. In the illustrated embodiment, these and other power drives to be described hereinafter are hydraulic motors.

A pair of flanged wheels 23 runs on each rail 3, 4 and supports support frame 22 thereon for movement of the support frame with machine frame 1 along track 6. The flanged wheels of each pair are spaced from each other in the direction of the rails and each wheel 23 has a flange arranged for engagement with the respective insides of the rails whereby the flanged wheels are adapted to serve as lining rollers upon lateral movement of the support frame on operation of drives 44.

As shown, support frame 22 has two upwardly extending, parallel holder arms 24 associated with each rail. Hydraulic motors 12 associated with the respective rails have an upper end linked to brackets 13 projecting from machine frame portion 15 while their lower ends 25 are linked to the holder arms so that operation of the motors will vertically move support frame 22.

Lifting tool 26 is mounted on support frame 22 intermediate flanged wheels 23 of each pair of flanged wheels in the direction of the rails and each lifting tool is associated with one of the track rails. Each lifting tool has a hook 30 capable of selectively gripping rail head 28 and rail base 29 at the outside of the associated track rail. Pivot 27 mounts the upper end of each lifting tool 26 on the upper ends of parallel holder arms 24 of support frame 22. The pivots extend in a direction substantially parallel to the longitudinal extension of the machine and enable the lifting tools to be pivoted in an operating movement in a plane extending transversely and perpendicularly relative to the track, hooks 30 being arranged to move practically rectilinearly during the operating movement of the tools. As shown in FIG. 3, the angle $\alpha$ of the pivotal operating movement of the lifting tools relative to the oblique underside of rail heads 28 is so dimensioned as to wedge hooks 30 automatically into secure engagement with the underside of the rail heads. The distance of pivot 27 from gripping hook 30 of the lifting tool provides a radius of the operating movement sufficiently large to obtain the practically rectilinear movement of the hook. This distance may be at least about three times the height of the rails, about half the gauge of the track or about twice the distance between the axes of flanged wheels 23 of each pair associated with lifting tool 26. These dimensions have been found to produce good gripping conditions even where the angular operating movement of the lifting tool is relative large. A power drive constituted by hydraulic motors 41 is connected to each lifting tool 26 and extends transversely to the longitudinal extension of the machine to pivot the lifting tool about pivot 27 for executing the operating movement thereof, respective ends of the hydraulic motor being connected to support frame 22 in the center region and close to hook 30 to the lifting tool. As will be explained more fully hereinafter, each hook 30 has an additional motion relative to the flanged wheels for selectively gripping the rail head and rail base of the associated track rail and rail 42 adjacent to the outside of one of the track rails.

In the embodiment of FIGS. 2 and 3, lifting tool 26 is elongated and comprises two parts longitudinally adjustable relative to each other, one of the parts being hook 30. The other tool part is a narrow frame and hook part 30 is guided for longitudinal adjustment relative thereto in vertical guide 31 defined by the narrow frame part of the tool so that, upon vertical adjustment of the hook along the guide, the hook may selectively grip rail head 28 or rail base 29. Power drive means illustrated as hydraulic motor 33 extends through the narrow frame part of tool 26 and is linked to hook 30 for longitudinal adjustment thereof to impart the additional motion thereto. Each lifting tool has an adjustable blocking mechanism 34 to hold hook 30 in a selected vertical position for gripping the rail head or base. The illustrated blocking mechanism comprises bracket 35 projecting from the tool and carrying slide 37 adjustable by operation of hydraulic motor 36 to move between stop 38 rigidly connected to hook 30 and stop 40 adjustable by set screw 39.

The elongated lifting tool with its hook at one end may be of substantial length and may, therefore, be constructed much more sturdily than conventional rail lifting hooks. The hook itself may be shaped for better gripping engagement with the parts of the track to be held by the hook since the movement of the hook itself will be practically rectilinear, thus enabling the hook to be wedged into gripping engagement and being prevented from gliding off the gripped rail during lifting. The lifting tools operate with greater ease in all areas of a switch, the gripping forces are directed towards the center of the machine by slightly obliquely positioning the massively built lifting tools with their end hooks, and no portions of the support frame extend laterally beyond the track. The entire equipment may be operated with greater safety and ease because of the enhanced visibility due to the less voluminous support frame.

The above-described and illustrated operating movement of lifting tools 26 about upper pivot 27 is of particular advantage at switch points since the lifting forces will be absorbed exclusively in one direction of the movement and, thus, even the heaviest track switch apparatus with their ties fastened to the main and branch tracks may be securely lifted with this equipment. The visibility for the operator sitting in cab 18 is also improved since the center region between the track rails, which has been obscured by transverse guides for the lifting hooks in conventional equipment of this type, is now free of obscuring parts. This also enables the equipment to be constructively better adapted to machine frame 7 since the upper portion of lifting tools 26, which extends into the region of frame 7, may be readily guided in this frame.

With a two-part lifting tool in which hook 30 is guided in a narrow frame part and receives the additional motion by a hydraulic motor 33 built into the narrow frame part, the structure is further simplified and the visibility for the operator is accordingly further enhanced, this construction having further advantages with respect to the distribution of forces.

FIG. 3 illustrates in full and broken lines various operating positions of lifting tools 26. On the left side, hook 30 of lifting tool 26 associated with rail 3 is shown in its upper or rest position wherein the hook is held when the tamper is not used for track lifting, for instance when moved between working sites. On the right side, lifting tool 26 associated with rail 4 is shown in full lines in a position wherein hook 30 engages the rail under rail head 28. In this position, flanged wheels 23 engaging the inside of rail 4 and hook 30 engaging its outside grip the rail firmly therebetween like a pincer to hold rail 4 substantially rigidly. Since the lifting tool comprises a strong metal framework of cast iron or steel, for example, capable of sustaining about twice the weight of a track in a switch area, this massive and rigid structure enables the lifting tool to sustain the weight of any track switch without problems when support frame 22 is lifted by hydraulic motors 12 to level the track under the control of reference system 19.

FIG. 3 also shows that hook 30 at the end of lifting tool 26 may be readily inserted into gripping engagement with rail 4 where additional rail 42 extends closely adjacent the outside of track rail 4, leaving only little space between the two rails, as in a switch where rail 42 branches off.

In broken lines, right lifting tool 26 is shown pivoted through angle $\alpha$ to enable hook 30 to grip a branch rail spaced somewhat farther from rail 4 at another point of the switch. Hook 30 is shown in two vertical positions adjusted for gripping the head or the base of the branch rail spaced from rail 4 by distance x. Because of the large radius of the pivoting movement of lifting tool 26, the gripping conditions of hook 30 with respect to the branch rail are excellent although distance x is considerable. The arrangement of the hooks is such that the operating movement thereof has a sufficient range to enable hooks 30 to grip any desired portion of track rails 3, 4 and adjacent rail 42 at the head or the base of the rails, the range of the operating movement indicated by angle $\alpha$ being at least 30 cm in addition to the width of hook 30.

FIG. 3 clearly shows the relatively small width of equipment 11, compared with conventional equipment of this type useful for operation in track switches, no structural parts or guides extending laterally beyond lifting tool 26 for enabling the same to be displaced even to its outermost position.

As illustrated in the figure and is generally conventional, power drive means 44 for laterally moving support frame 22 of equipment 11 for lining the track is comprised of hydraulic motors extending transversely to the track and having one end linked to respective brackets 43 affixed to machine frame 7 and staggered from each other in the longitudinal direction of the machine frame while the other end of each hydraulic motor 44 is linked to the opposite side of support frame 22.

The compound motion providing for pivoting of the lifting tool in an operating movement in a plane extending transversely and perpendicularly relative to the track and an additional rectilinear motion of the hook substantially perpendicular to the pivotal operating movement makes it possible to provide all the advantages of the invention with a variety of structural embodiments one of which has been described hereinabove and illustrated in FIG. 3. Another structural embodiment is shown in FIG 4, both embodiments providing a sturdy construction of the lifting tool while providing minimal movements in the range of a switch point for lifting and laterally moving the track at this point, enabling the hook to grip any desired track portion without requiring the support frame itself to be moved for this purpose.

In the embodiment of FIG. 4, the lifting tools mounted on support frame 22 are rigid bell crank levers 45 each having first arm 46 extending sustantially parallel to the track consisting of rails 3 and 4 fastened to ties 55 and second arm 48 extending substantially vertically to the track. Pivot 27 mounts an inner end of first arm 46 on support frame 22 and second arm 48 carries hook 49 for the practically rectilinear operating movement. As shown, lifting tools 45 associated with the respective track rails are substantially symmetrically arranged with respect to a vertical center plane of the track. Equivalent to hydraulic motors 41 of the embodiment of FIG. 3, hydraulic motors 51 are linked respectively to the knees of bell crank levers 45 and brackets 52 affixed to support frame 22 to provide power drives for the pivotal operating movements of the lifting tools about pivots 27. Further power drive means constituted by double-acting hydraulic motor 50 is mounted centrally on the support frame between pivots 27 of the lifting tools and the piston rods of the hydraulic motor are linked to the pivots for independently laterally moving each lifting tool relative to support frame 22 in a rectilinear motion substantially perpendicularly to the pivotal operating movement to impart the additional motion to the lifting hooks.

This structure, too, provides a very compact equipment 11 for lifting and laterally moving track and each bell crank lever lifting tool may be produced from cast iron or steel in such a dimension as to be able to sustain the heavy weights of track switches.

What is claimed is:

1. A mobile track tamping machine mounted for mobility on a track consisting of ties resting on ballast to be tamped and two rails fastened to the ties, the rails defining the track gauge and each one of the rails having a rail head and a rail base, the rails defining respective insides facing each other and outsides facing away from each other, including equipment capable of lifting and laterally moving the track in sections of the track where an additional rail extends closely adjacent the outside of one of the track rails, the track lifting and moving equipment comprising (a) a support frame mounted on the machine for vertical and lateral movement relative thereto and to the track, (b) power drive means for vertically and laterally moving the support frame to effect lifting and laterally moving the track, (c) a pair of flanged wheels running on each one of the rails and supporting the support frame thereon for movement of the support frame along the track, (1) the flanged wheels of each one of the pairs being spaced from each other in the direction of the rails and (2) each one of the wheels having a flange arranged for engagement with the respective insides of the rails whereby the flanged wheels are adapted to serve as lining rollers upon lateral movement of the support frame, (d) an elongated lifting tool mounted on the support frame intermediate the flanged wheels of each pair of flanged wheels in the direction of the rails, each one of the lifting tools being associated with one of the track rails and being mounted for a pivotal operating movement in a vertical plane extending transversely to the track rails, each tool having (1) a hook capable of selectively gripping the rail head and rail base of the associated track rail and of the additional rail at the outside thereof, (e) additional power drive means for imparting to each one of the lifting tools the pivotal operating movement for selectively gripping the rail head and rail base of the associated track rail and the additional rail, (f) a pivot mounting each one of the lifting tools on the support frame, the pivot extending in a direction substantially parallel to the longitudinal extension of the machine and being positioned a substantial distance from the hook which enables the hook of each lifting tool to move practically rectilinearly during the pivotal operating movement of the tools, and (g) further power drive means for imparting to the hooks an additional motion in said plane transversely to the rectilinear movement of the hooks for selectively gripping the rail head and rail base.

2. The mobile track tamping machine of claim 1, wherein the further power drive means comprises a respective drive connected to each one of the tools and capable of imparting to the hooks the additional motion in a substantially rectilinear movement substantially perpendicular to the pivotal operating movement of the lifting tools.

3. The mobile track tamping machine of claim 1, wherein the lifting tool comprises two parts, one of the parts being the hook, and the two lifting tool parts being longitudinally adjustable relative to each other, and the further power drive means comprises a respective drive connected to the hook for longitudinal adjustment thereof to impart the additional motion thereto.

4. The mobile track tamping machine of claim 3, wherein the lifting tool is positioned substantially in a plane defined by the associated rail and extending vertically relative to the track, or a plane parallel thereto, and the pivot mounts an upper end of the lifting tool on the support frame.

5. The mobile track tamping machine of claim 3 or 4, wherein the other lifting tool part is a narrow frame wherein the hook part is guided for longitudinal adjustment relative thereto, the further power drive means extending through the narrow frame part.

6. The mobile track tamping machine of claim 1, wherein the lifting tool is a rigid bell crank lever having a first arm extending substantially parallel to the track and an elongated second arm extending substantially vertically to the track, the pivot mounting an inner end of the first arm on the support frame and the second arm carrying the hook for the practically rectilinear movement thereof.

7. The mobile track tamping machine of claim 6, wherein the lifting tools associated with the track rails are substantially symmetrically arranged with respect to a vertical center plane of the track, and the further power drive means are connected to the pivot of each one of the lifting tools for independently laterally moving the lifting tools relative to the support frame substantially perpendicularly to the pivotal operating movement to impart the additional motion to the lifting hooks.

8. The mobile track tamping machine of claim 1, wherein each one of the lifting tools comprises a strong metal framework capable of sustaining about twice the weight of a track in a switch area.

9. The mobile track tamping machine of claim 1, wherein the arrangement of the hooks is such that the operating movement thereof has a sufficient range to enable the hooks to grip any desired portion of the track rails and the rail adjacent thereto at the head and the base of the rails, the range of the operating movement being at least 30 cm in addition to the width of the hook.

10. The mobile track tamping machine of claim 1, the rail heads having an oblique underside, wherein the angle of the pivotal operating movement of the lifting tools relative to the oblique underside of the rail heads is so dimensioned as to wedge the hooks automatically into secure engagement with the underside of the rail heads.

11. The mobile track tamping machine of claim 1, wherein the substantial distance of the pivot from the gripping hook of the lifting tool is about half the gauge of the track to provide a radius of the operating movement sufficiently large to obtain the practically rectilinear movement.

12. The mobile track tamping machine of claim 1, wherein the substantial distance of the pivot from the gripping hook of the lifting tool is about twice the distance between the axes of the flanged wheels of each pair associated with the lifting tool to provide a radius of the operating movement sufficiently large to obtain the practically rectilinear movement.

* * * * *